US007032869B2

(12) United States Patent
Edwards et al.

(10) Patent No.: US 7,032,869 B2
(45) Date of Patent: Apr. 25, 2006

(54) DECORATIVE CHAIR BASE ASSEMBLY

(75) Inventors: Tom Edwards, Spring Lake, MI (US); Errol Pearsons, Grand Haven, MI (US); Gary Schmitt, Evansville, IN (US); Brian Yeckering, Owensboro, KY (US); Odie Eaves, Utica, KY (US); Rick Rimer, Cincinnati, OH (US)

(73) Assignee: HNI Technologies Inc., Muscatine, LA (US)

( * ) Notice: Subject to any disclaimer, the term of this patent is extended or adjusted under 35 U.S.C. 154(b) by 81 days.

(21) Appl. No.: 10/852,741

(22) Filed: May 24, 2004

(65) Prior Publication Data

US 2005/0258320 A1 Nov. 24, 2005

(51) Int. Cl.
*A47B 91/00* (2006.01)

(52) U.S. Cl. ..... 248/188.7; 248/345.1

(58) Field of Classification Search ..... 248/188.7, 248/345.1; 297/411.2, 411.46
See application file for complete search history.

(56) References Cited

U.S. PATENT DOCUMENTS

| | | | | | |
|---|---|---|---|---|---|
| 334,756 | A | * | 1/1886 | Denver | 297/411.45 |
| D194,741 | S | | 3/1963 | Deaton | |
| D204,189 | S | | 3/1966 | Dillon | |
| 3,390,421 | A | * | 7/1968 | Sullivan | 16/30 |
| 3,443,782 | A | | 5/1969 | Fields et al. | |
| 3,497,170 | A | | 2/1970 | Armstrong | |
| 3,705,704 | A | | 12/1972 | Textoris | |
| D266,722 | S | | 11/1982 | Stephens | |
| 4,361,357 | A | | 11/1982 | Pollock | |
| 4,534,533 | A | * | 8/1985 | Doerner | 248/345.1 |
| 4,744,538 | A | * | 5/1988 | Hofman | 248/345.1 |
| 5,048,780 | A | * | 9/1991 | Borsani | 248/188.7 |
| D354,178 | S | | 1/1995 | Ochsner | |
| 5,402,973 | A | * | 4/1995 | Haines | 248/188.7 |
| D368,172 | S | | 3/1996 | Locher | |
| D369,689 | S | | 5/1996 | Locher | |
| D403,519 | S | | 1/1999 | Stafford | |
| 5,938,156 | A | | 8/1999 | Kao | |
| D427,793 | S | | 7/2000 | Groulx et al. | |
| D469,283 | S | | 1/2003 | Chen | |
| D470,691 | S | | 2/2003 | Chen | |

* cited by examiner

*Primary Examiner*—Korie Chan
(74) *Attorney, Agent, or Firm*—Faegre & Benson LLP

(57) ABSTRACT

A decorative chair base having a metal substructure, a single molded plastic cover and a plurality of decorative inserts. The metal substructure has a central hub and radiating leg portions. At the extended ends of the leg portions are sleeves for mounting casters. The plastic cover also has a central hub and leg portions. The central hub of the cover fits over the central hub of the substructure and each leg portion of the cover overlays a leg portion of the substructure. Each leg portion of the cover has a raised end section, and a recess and there is a raised section surrounding the hub portion. An insert is mounted in each recess so as to be flush with the raised portions.

26 Claims, 4 Drawing Sheets

DECORATIVE CHAIR BASE ASSEMBLY

CROSS REFERENCE TO PRIORITY APPLICATIONS

Not applicable.

STATEMENT REGARDING FEDERALLY SPONSORED RESEARCH

Not applicable.

BACKGROUND OF THE INVENTION

1. Field of the Invention

The present invention relates to a chair base and more particularly, to an aesthetically pleasing, versatile and relatively inexpensive decorative chair base for swivel type chairs.

2. Description of the Related Art

Office type chairs typically ride on a five-legged base mounted to casters to provide facilitated chair mobility. Chair bases are typically made of metal, plastic covered metal, wood or metal with wood cladding. These bases are also typically unobstrusive by having a black matted surface or slightly decorative with a high gloss wood finish. More recently chairs with external metal frame members have complementing metal bases.

There continues to be a desire to integrate the base design with styling features of the chair to more closely tie the aesthetics of the chair together, but to do so in an easily assembled and relatively inexpensive manner.

BRIEF SUMMARY OF THE INVENTION

What is described here is a decorative swivel base for a chair comprising a metal substructure having a central hub and radiating leg portions, a plastic cover attached to the substructure and having a hub portion disposed around the central hub of the substructure and leg portions overlaying the radiating leg portions of the substructure, the cover leg portions overlaying the radiating substructure leg portions, each including a recess, and a plurality of decorative inserts, each of the decorative inserts placed in a corresponding recess of the plastic cover.

There are a number of advantages, features and objects achieved with the present invention which are believed not to be available in earlier related devices. For example, one advantage is that the base is more decorative and more stylistically integrated with the chair mounted to the base. Another object of the present invention is to provide a decorative base which is very easily assembled. Further features of the base disclosed here is simplicity of construction, robust structure and relative inexpensiveness.

A complete understanding of the present invention and other objects, advantages and features thereof will be gained from a consideration of the present specification which provides a written description of the invention and of the manner and process of making and using the invention, set forth in such full, clear, concise, and exact terms as to enable any person skilled in the art to which it pertains, or with which it is most nearly connected, to make and use the same in compliance with Title 35 U.S.C. section 112 (first paragraph). Furthermore, the following description of preferred embodiments of the invention read in conjunction with the accompanying drawing provided herein represent examples of the invention in compliance with Title 35 U.S.C. section 112 (first paragraph), but the invention itself is defined in the Claims section attached hereto.

DETAILED DESCRIPTION OF A PREFERRED EMBODIMENT OF THE INVENTION

Figure 1:
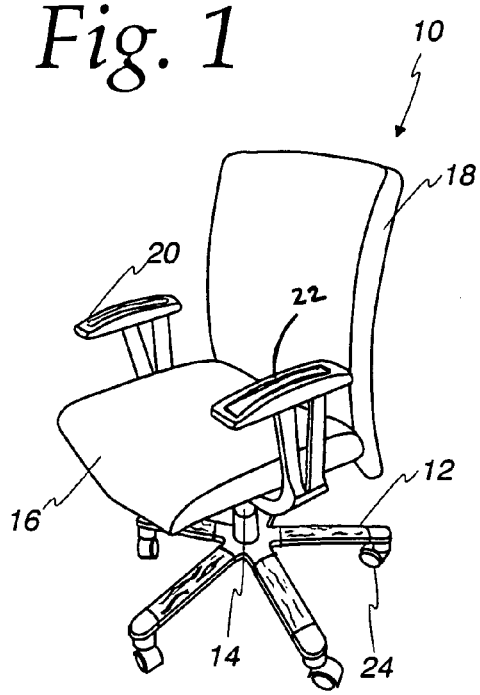
FIG. 1 is an isometric view of a swivel type chair with a decorative chair base.

While the present invention is open to various modifications and alternative constructions, the preferred embodiments illustrating the best mode contemplated by the inventors of carrying out their invention are shown in the various figures of the drawing and will be described herein in detail, pursuant to Title 35 U.S.C. section 112 (first paragraph). It is understood, however, that there is no intention to limit the invention to the particular embodiments, forms or examples which are disclosed herein. To the contrary, the intention is to cover all modifications, equivalent structures and methods, and alternative constructions falling within the spirit and scope of the invention as expressed in the appended Claims section attached hereto, pursuant to Title 35 U.S.C. section 112 (second paragraph).

An office chair 10 is shown in FIG. 1 and includes a decorative base 12, an adjustable support column 14, a seat portion 16, a back portion 18 and a pair of arms 20, 22. The office chair is mounted to a set of casters, such as the caster 24, which allows the chair to be moved easily toward and away from a desk, for example.

Figure 2:
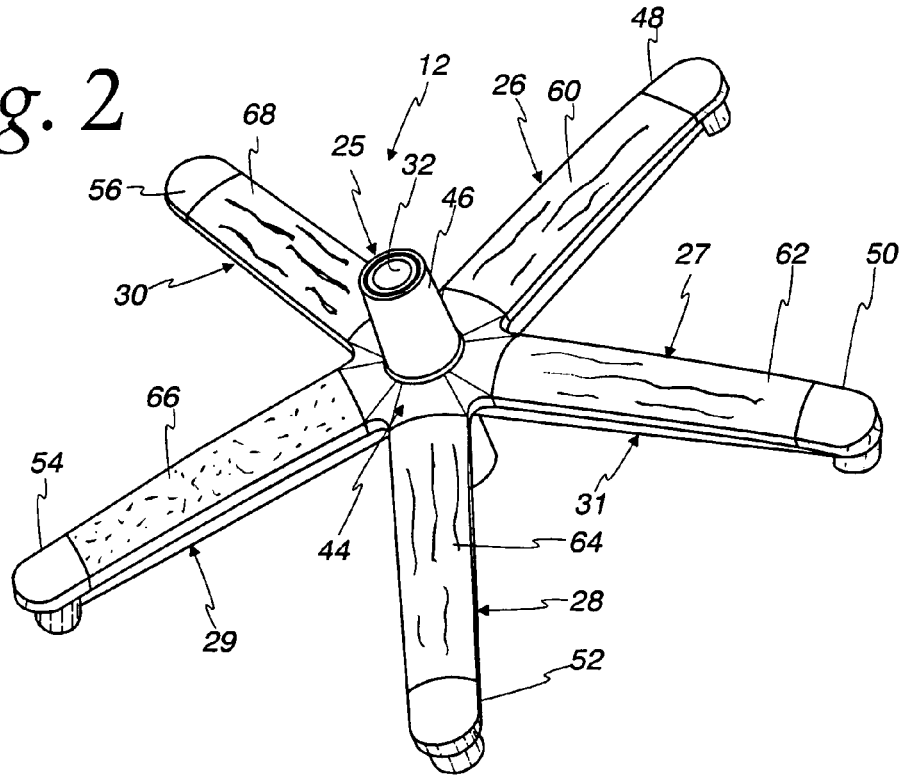
FIG. 2 is a downwardly looking isometric view of the decorative chair base.
Figure 3:
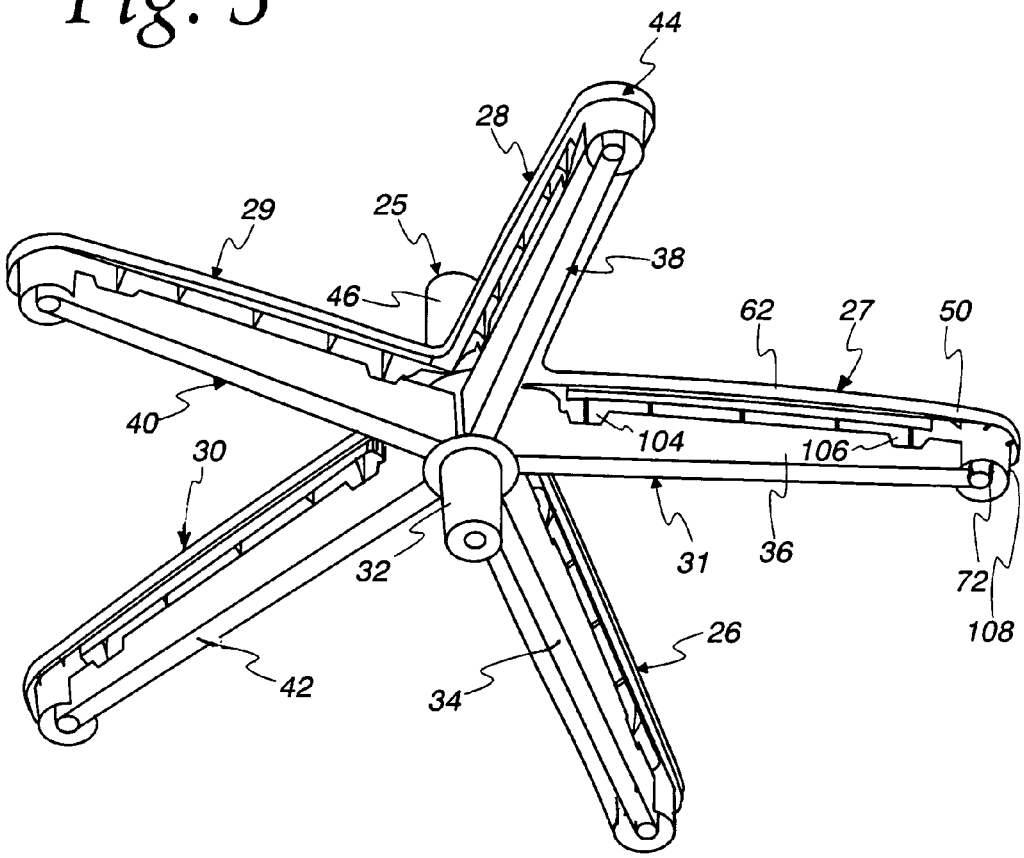
FIG. 3 is an upwardly looking isometric view of the decorative chair base.
Figure 4:
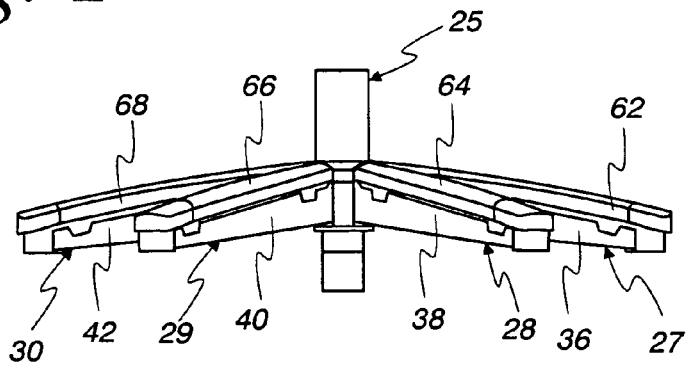
FIG. 4 is an elevation view of the decorative chair base.

Referring now to FIGS. 2–4, the decorative base 12 is shown in more detail. The decorative base includes a central hub 25 and five legs 26, 27, 28, 29, 30 radiating outwardly from the hub and being equally spaced, about seventy two degrees from one leg to an adjacent leg.

The swivel base 12 is assembled of three main parts, a bottom metal substructure, a plastic cover and a plurality of decorative inserts. The bottom metal substructure 31 which is formed into a hub portion 32 and five radiating leg portions 34, 36, 38, 40, 42. Mounted over the metal substructure is the one piece molded plastic cover 44 which also includes a hub portion 46 and five leg portions 48, 50, 52, 54, 56 radiating outwardly from the hub portion and mounted to cover the five leg portions of the metal substructure.

Mounted to each of the leg portions of the plastic cover are the decorative inserts 60, 62, 64, 66, 68.

Figure 5:
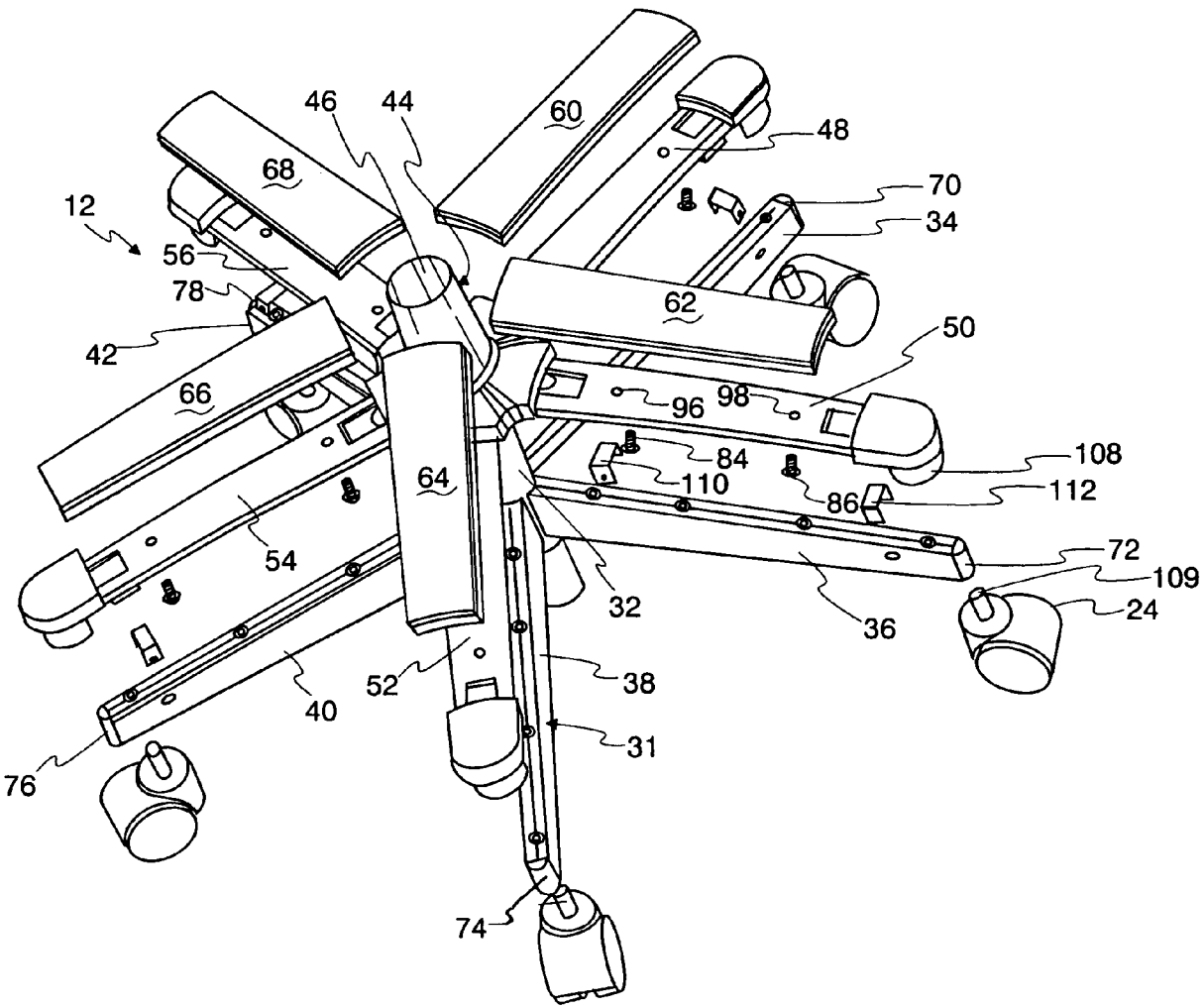
FIG. 5 is an exploded isometric view of the decorative chair base.
Figure 6:
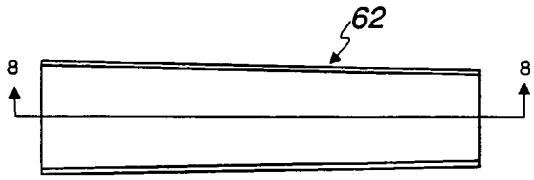
FIG. 6 is a plan view of a decorative chair base insert.
Figure 7:
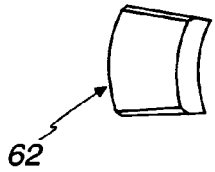
FIG. 7 is an elevation view of the insert.

The robust but simple structure of the decorative base is illustrated in FIGS. 3 and 5. The metal substructure 31 is comprised of any suitable strong material, preferably steel, which is welded together to take the form shown. Welded to the extended ends of each of the substructure leg portions are metal sleeves 70, 72, 74, 76, 78. The inner end of each leg portion 34, 36, 38, 49, 42 is welded to the hub portion 32. The substructure is very strong and yet not overly expensive.

Figure 8:
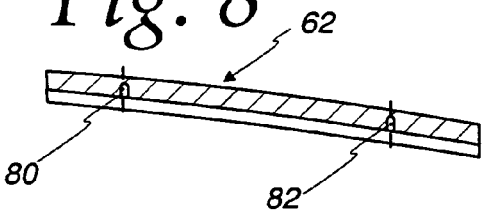
FIG. 8 is a longitudinal section view taken along line 8—8 of FIG. 6.

Referring now to FIGS. 5–8, there is shown one of the inserts in more detail. The insert 62 can be made of any suitable material, preferable wood, although plastic or metal may also be used. The insert is tapered in plan view from approximately 2.3 inches in width near the hub, to a width of about two inches about nine inches away along a longitudinal axis. The insert 62 is curved both longitudinally and laterally. In a longitudinal direction, as best seen in FIG. 8, the insert forms a gentle arc having a radius of about ninety inches. Laterally, the insert has a curve having a radius of approximately three inches. Each of the inserts includes two screw receiving openings 80, 82. As shown in FIG. 5, screws, such as the screws 84, 86, are received through the plastic cover and into the inserts for a simple, yet strong attachment of the inserts to the plastic cover.

The upper surface of the insert may have any one or more of a variety of finishes and surface textures depending upon the stylistic approach used in the chair mounted to the base. For example, a preferable insert may be wood having a highly polished surface as shown in insert 60, 62, 64 and 68, FIG. 2. Another preferable insert having a textured surface is shown as part of the insert 66. It should be noted that this surface may find a complementary stylistic touch by having similar inserts imbedded in the chair arms 20, 22 as shown in FIG. 1.

Figure 9:
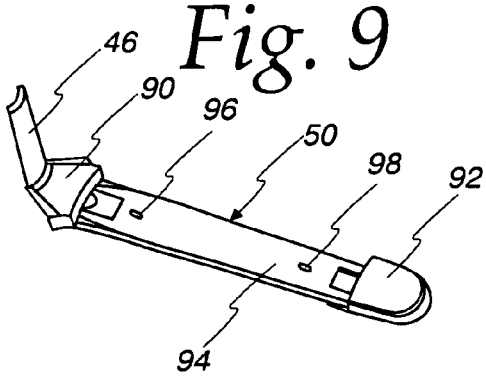
FIG. 9 is an isometric view of a portion of a decorative chair base plastic cover.
Figure 10:
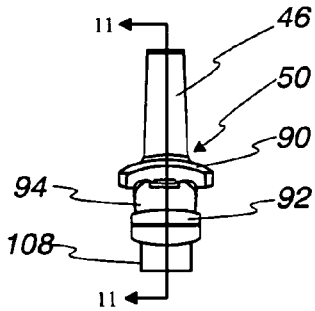
FIG. 10 is an elevation view of the plastic cover portion shown in FIG. 9.

The plastic cover 44 may be molded from one piece as shown in FIG. 5. The plastic cover, for purposed clarity and illustration, is graphically divided in FIGS. 9–11, to show only one leg portion 50 and only one-fifth of the hub portion 46. Each of the cover leg portions is angled away from a generally vertical, slightly tapered integral hub portion 46 at an angle of about one hundred degrees. The plastic cover has a raised inner section or landing 90 immediately surrounding the hub portion. Each leg portion also includes a raised outer end 92 above the position where the casters are fitted. Between the raised inner portion and the raised outer end is a recess section 94 which is structured and dimensioned to receive the insert in a flush manner, both along the top surfaces of the cover raised portions and the insert and also along the side surfaces of the insert and the plastic cover. The flush fit is best illustrated in FIGS. 2 and 3.

Mounting the inserts flush into the recesses of the plastic cover provides an enhanced appearance and also provides protection of the decorative insert from the accidental scuffing and the like by the feet of a chair user. Each leg portion also includes two screw openings 96, 98 for receiving screws, such as the screws 84, 86, that pass through the plastic cover screw openings 96, 98 and into the openings 80, 82 formed in the inserts. As mentioned, this arrangement provides a secure attachment of the inserts to the plastic cover.

Figure 11:
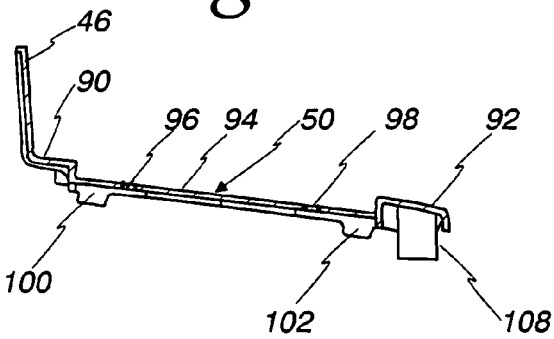
FIG. 11 is a longitudinal section view taken along line 11—11 of FIG. 10.

The plastic cover also includes opposing clip flaps, such as the clip flaps 100, 102, FIG. 11, on one side of the cover leg portion 50 and clip flaps 104 and 106, FIG. 3, on the other side of the leg portion. At the extended end section of each leg portion of the plastic cover is a cylindrically shaped cup, such as the cup 108, FIGS. 3, 10 and 11, for covering the sleeves, such as the sleeve 72, FIGS. 3 and 5, welded to the ends of each of the substructure leg portions. The sleeves receive the stems of inserted casters, such as the stem 109 of the caster 24, FIG. 5.

Each leg portion of the plastic cover is attached to a corresponding leg portion of the metal substructure by use of attachment clips, such as attachment clips 110 and 112, FIG. 5. The attachment clips are engaged with the leg portions of the plastic cover and also with the leg portions of the substructure. When assembled, the attachment clips are covered by the clip flaps of the plastic cover.

Assembly of the decorative base is relatively simple and straight forward. After forming the inserts, molding the plastic cover, and welding the substructure, the inserts are attached to the plastic cover by screws. Thereafter, the combination of the inserts and the plastic cover are connected to the metal substructure by use of the attachment clips. The attachment clips frictionally engage the metal substructure along inside surfaces of each clip and at the same time frictionally engage the plastic cover along outside surfaces of each clip so that the configuration shown in FIGS. 2 and 3, for example, are maintained. Thereafter, casters may be inserted in each of the sleeves attached to the ends of the substructure leg portions.

The above specification describes in detail preferred embodiments of the present invention. Other examples, embodiments, modifications and variations will, under both the literal claim language and the doctrine of equivalents, come within the scope of the invention defined by the appended claims. For example, changing the number of legs or the shapes of the substructure, or of the plastic cover, or of the inserts will be considered equivalent structures and will also come within the literal language of the claims. Also altering the material or upper surfaces of the inserts will also be considered equivalent structures. Still other alternatives will also be equivalent as will many new technologies. There is no desire or intention here to limit in any way the application of the doctrine of equivalents nor to limit or restrict the scope of the invention.

The invention claimed is:

1. A decorative swivel base for a chair comprising:

a metal substructure having a central hub and radiating leg portions;

a plastic cover attached to said metal substructure and having a hub portion disposed around said central hub of said substructure and cover leg portions overlaying said radiating leg portions of said substructure, said cover leg portions each including a recess;

a plurality of clips attaching said plastic cover to said substructure; and a plurality of decorative inserts, wherein each of said decorative inserts is mounted in a corresponding recess in the cover leg portions.

2. The decorative swivel base of claim 1 wherein: said substructure includes a caster sleeve attached to an extended end of each of said substructure leg portions.

3. The decorative swivel base of claim 1 including: a set of casters, one caster connected to an end of a corresponding substructure leg portion.

4. The decorative swivel base of claim 2 including: a set of casters, one caster connected to a corresponding caster sleeve attached to said substructure leg portions.

5. The decorative swivel base of claim 1 wherein: said plastic cover is a single integral piece.

6. The decorative swivel base of claim 5 wherein: said plastic cover includes an integral cylindrical hub sleeve for receiving said central hub of said substructure.

7. The decorative swivel base of claim 6 wherein: said plastic cover includes a raised portion around said hub portion.

8. The decorative swivel base of claim 7 wherein; said plastic cover includes raised portions at extended ends of said substructure leg portions.

9. The decorative swivel base of claim 8 wherein: said leg portions of said plastic cover each includes an end section having a cylindrical shape.

10. The decorative swivel base of claim 9 wherein: said plastic cover includes depending integral clip flaps.

11. The decorative swivel base of claim 5 wherein: said plastic cover includes depending integral clip flaps.

12. The decorative swivel base of claim 1 wherein: said plastic cover includes an integral cylindrical hub sleeve for receiving said central hub of said substructure.

13. The decorative swivel base of claim 1 wherein: said plastic cover includes a raised portion around said hub portion.

14. The decorative swivel base of claim 1 wherein: said plastic cover includes raised portions at extended ends of said substructure leg portions.

15. The decorative swivel base of claim 1 wherein: said leg portions of said plastic cover each includes an end section having a cylindrical shape.

16. The decorative swivel base of claim 1 wherein: each of said leg portions of said plastic cover includes multiple screw receiving openings.

17. The decorative swivel base of claim 1 wherein: said plastic cover includes depending clip flaps depending from said cover leg portion.

18. The decorative swivel base of claim 1 wherein: each of said decorative inserts mounts flush to said plastic cover.

19. The decorative swivel base of claim 1 wherein: each of said decorative inserts includes a longitudinal axis; and each of said decorative inserts has a curved shape along said longitudinal axis.

20. The decorative swivel base of claim 1 wherein: each of said decorative inserts includes a longitudinal axis; and each of said decorative inserts has a curved shape in a direction perpendicular to said longitudinal axis.

21. The decorative swivel base of claim 1 wherein: each of said decorative inserts includes screw receiving openings.

22. The decorative swivel base of claim 1 wherein: each of said decorative inserts includes a top surface and opposing side surfaces.

23. The decorative swivel base of claim 1 wherein: each of said decorative inserts includes a longitudinal axis; each of said decorative inserts has a curved shape along said longitudinal axis; said substructure includes a caster sleeve attached to an extended end of each of said substructure leg portions; and including a set of casters, one caster connected to an end of a corresponding substructure leg portions.

24. The decorative swivel base of claim 23 wherein: each of said decorative inserts has a curved shape in a direction perpendicular to said longitudinal axis.

25. The decorative swivel base of claim 24 wherein: each of said decorative inserts includes screw receiving openings.

26. The decorative swivel base of claim 25 wherein: each of said decorative inserts includes a top surface and opposing side surfaces.

* * * * *